US006298501B1

(12) United States Patent
Beichner

(10) Patent No.: US 6,298,501 B1
(45) Date of Patent: Oct. 9, 2001

(54) BATHING STRUCTURE TABLE AND ASSOCIATED METHOD

(76) Inventor: Linda M. Beichner, 249 King Richard Dr., McMurray, PA (US) 15317

( * ) Notice: Subject to any disclaimer, the term of this patent is extended or adjusted under 35 U.S.C. 154(b) by 0 days.

(21) Appl. No.: 09/224,666

(22) Filed: Dec. 31, 1998

(51) Int. Cl.[7] ..... A47K 3/00

(52) U.S. Cl. ..... 4/559; 4/496; 108/150

(58) Field of Search ..... 4/559, 661, 571.1, 4/578.1, 579, 541.1, 496; 108/24, 27, 50.11, 157.16, 150

(56) References Cited

U.S. PATENT DOCUMENTS

| | | | | |
|---|---|---|---|---|
| 145,145 | * | 12/1873 | Baggs | 108/150 |
| 339,741 | * | 4/1886 | Clough | 108/150 |
| 351,649 | * | 10/1886 | Newman | 108/150 |
| 797,990 | * | 8/1905 | Treichel | 108/150 |
| 4,656,678 | * | 4/1987 | Lipski | 4/578 |
| 4,724,773 | * | 2/1988 | Newberry et al. | 108/150 |
| 5,105,485 | * | 4/1992 | Sciabarassi | 4/656 |
| 5,353,716 | * | 10/1994 | Wilbert | 108/150 |
| 5,572,750 | * | 11/1996 | Johnston | 4/496 |
| 5,823,121 | * | 10/1998 | Reiter | 108/147.19 |

FOREIGN PATENT DOCUMENTS

| | | | | |
|---|---|---|---|---|
| 28-953 | * | 5/1981 | (EP) | 4/578.1 |

* cited by examiner

*Primary Examiner*—Charles R. Eloshway
(74) *Attorney, Agent, or Firm*—David C. Jenkins; Michael D. Lazzara; Eckert Seamans Cherin & Mellott, LLC

(57) ABSTRACT

An apparatus and associated method for supporting items, such as toys, with a bathing structure in a bathing environment is provided. The apparatus may include an upwardly tapered pedestal support which has a support tray mounted at one end and which is mounted at an opposite end to the base of a bathing structure. The support tray is suitable for placement and retrieval of items used in a bathing environment.

18 Claims, 3 Drawing Sheets

BATHING STRUCTURE TABLE AND ASSOCIATED METHOD

BACKGROUND OF THE INVENTION

1. Field of the Invention

The field of the present invention generally relates to apparatus and methods employed in a bathing environment. The present invention more particularly relates to an apparatus and associated method for supporting items used in conjunction with a bathing structure or in a bathing environment.

2. Description of the Prior Art

Methods and apparatus for supporting items, such as toys, in a bathing environment or in conjunction with a bathing structure may be provided in various ways.

U.S. Pat. No. 3,213,565 provides an aquatic toy adapted for use in bathtubs or other bathing appliances. This patent discloses a playboard which has a minimum length in order to be supported against the walls of a bathtub by stop devices secured to the underside of the playboard which abut against the inside walls of the bathtub. The patent also discloses grooves in the playboard for diverting collected water back into the bathtub, and a depression for receiving soap.

U.S. Pat. No. 2,006,169 generally relates to improvements in book rests for bathtubs. The patent discloses that two primary objects of its apparatus are to provide a construction which may be readily adjusted to bathtubs or other articles of furniture of various sizes and to provide a construction having a rack adapted for supporting books, mirrors and the like, and which is readily foldable into compact form.

U.S. Pat. No. 3,417,875 discloses a convenience rack which may be used as a rest for reading material, comfort items, a drying tray and the like. This patent discloses a convenience rack comprising a tray with opposed upstanding sidewalls. Support members laterally extend from opposite sides of the tray so that the tray may be bridged between the walls of a bathtub. The tray may also be stored as a decorative hanging from a generally horizontal support.

U.S. Pat. No. 5,621,927 discloses a bathtub caddie for use with a bookstand and a support structure for holding a bookstand in the vicinity of a conventional bath. The patent also discloses that suction cups may be coupled to the support arm in order to attach the support arm to a suitable structure located adjacent to a conventional bathtub such as a tile wall.

U.S. Pat. No. 5,761,753 provides a device for enabling a person to read, write, smoke or conduct other activities while bathing. This patent discloses that a book holder is removably attached to the main support bar and a rotatable book ledge/tray member is also mounted to the main support bar. The patent discloses that the telescoping support tube is releasably mounted to a ledge of a bathtub by a suction cup.

U.S. Pat. No. 4,656,678 discloses a bathtub stool. The patent discloses that the stool comprises a perforated seat positioned on a pair of U-shaped hoops which extend laterally to contact with the sidewalls of the bathtub. The U-shaped hoops are connected to the seat and serve as legs which are movable relative to the seat.

Among the things lacking in the prior art are an apparatus and associated method for supporting items, such as toys, in a bathing environment which provide for attachment of the support device to the base of a bathing structure. There remains a real and substantial need for an apparatus and method for supporting items in a bathing environment which provide accessibility to the items without causing excess liquid to exit the bathing environment. What is also needed is an apparatus and associated method which provide for a support tray at a height from which items, such as toys used by a child, may be easily obtained without necessitating standing or walking in the bathing structure. There is also a real and substantial need for a table support apparatus which resists water from exiting a bathing structure when items are placed on the supporting tray of the table.

SUMMARY OF THE INVENTION

The tub table apparatus and method of the present invention have met or exceeded the shortcomings of the prior art devices provided for supporting items in a bathing environment or in conjunction with a bathing structure.

The tub table of the present invention is designed for use with a bathing structure having a base and continuously upwardly projecting sidewalls. It includes a pedestal support having both upper and lower portions, the lower portion being capable of securement to the base of a bathing structure. It further includes a tray mounted at its lower surface to the upper portion of the pedestal support. The pedestal support may include a device such as a suction cup for removably securing the pedestal support to the base of a bathing structure. The lower portion of the pedestal support may be enlarged for increasing stability of the apparatus such as by providing an enlarged support base, a plurality of feet, or a multitude of suction cups.

In a method embodiment of the present invention, a pedestal support is provided with a tray mounted thereon. The pedestal support is secured by its lower portion to the base of a bathing structure. The pedestal support and tray structure are then used to support items in a bathing environment which may include using the tray of the present invention to support toys.

It is an object of the present invention to provide a support tray which will resist items such as toys from falling into a bathing structure.

It is an object of the present invention to resist a user's inclination to place items around the periphery of a bathing structure.

It is an object of the present invention to resist water from exiting a bathing structure.

It is an object of the present invention to provide a support tray at a height which is readily usable by a person employing items in a bathing environment.

It is an object of the present invention to provide an apparatus which may safely be placed in a bathing structure with a child bather without meaningful risk of injury to the child bather.

These and other objects of the present invention will be more fully understood from the following description of the invention on reference to the illustrations appended hereto.

DETAILED DESCRIPTION OF THE INVENTION

As used herein, a "bathing structure" is defined as any structure adapted to receive water which is used by a human being, including but not limited to, bathtubs, sinks, hot tubs, spas, wading pools, showers and swimming pools.

Figure 1:
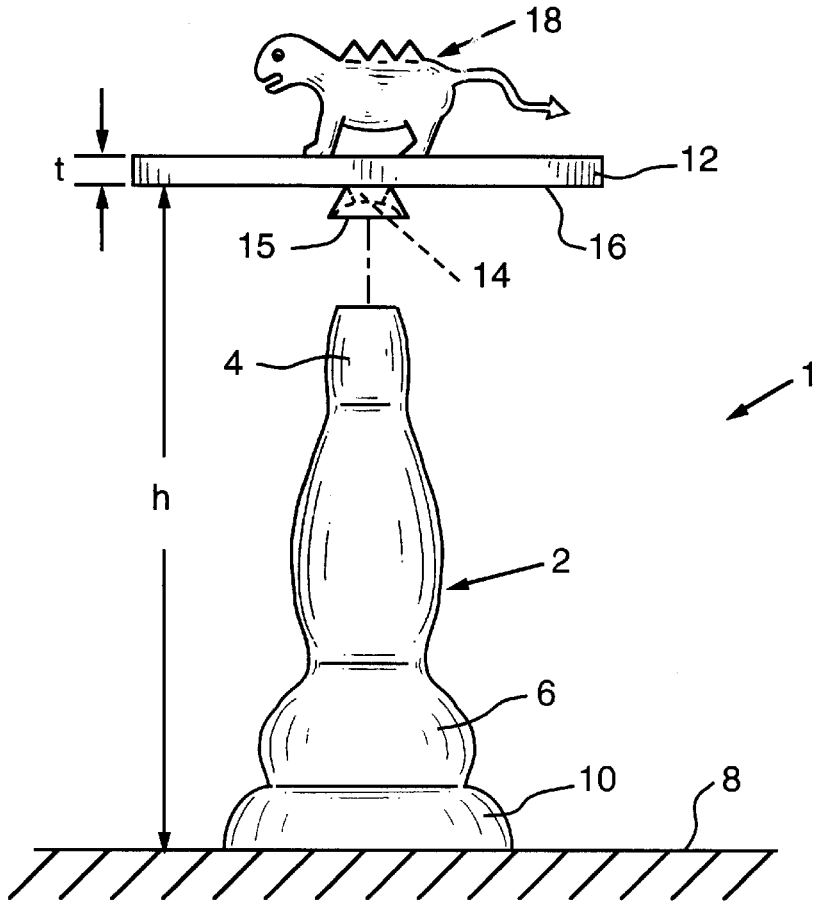
FIG. 1 is a front exploded view of the tub table of the present invention.

Referring now to FIG. 1, the tub table 1 of the present invention is provided comprising a pedestal support 2 having an upper portion 4 and a lower portion 6. The lower portion 6 is removably securable to a base 8 of a bathing structure 22, such as by suction cup 10 which provides secure and releasable attachment between the lower portion 6 and the base 8. A support tray 12 is mounted to the upper portion 4 of pedestal support 2. Attachment between support tray 12 and upper portion 4 may be facilitated by use of an apparatus such as mounting device 14 secured to a lower surface 16 of the support tray 12. Mounting device 14 may be conventionally structured so as to provide optionally for either releasable or substantially permanent securement with upper portion 4 of the pedestal support 2. The mounting device 14 may be secured to the support tray 12 by conventional fasteners or may be formed integrally with support tray 12. As shown, the mounting device 14 may comprise a downwardly open bore 15 which may be designed to fit frictionally onto upper portion 4 with or without the aid of mechanical fasteners depending on whether or not the support tray 12 is permanently or removably attached to upper portion 4.

Figure 2:
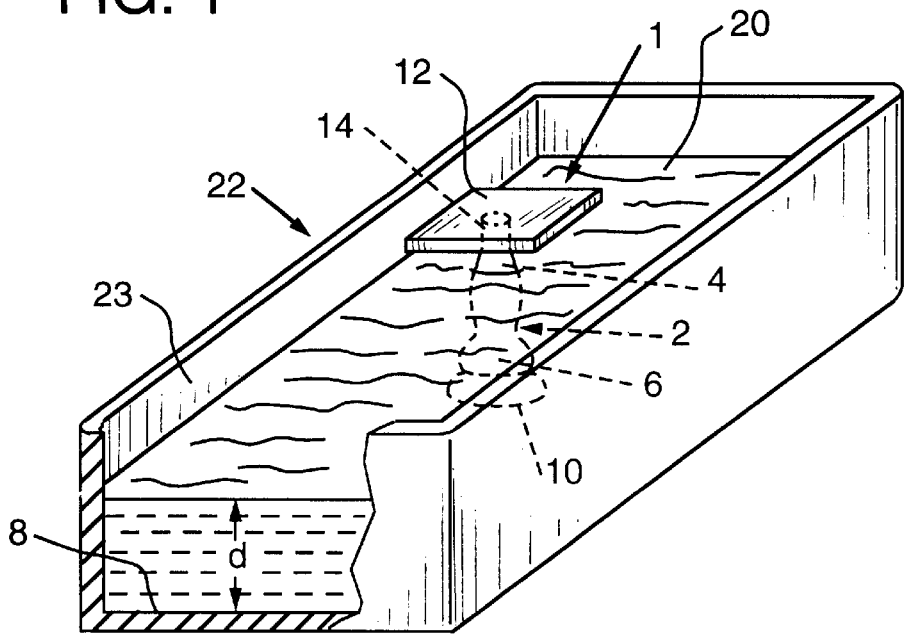
FIG. 2 is a perspective cut-away view of the tub table in a bathing structure.

Referring now to FIGS. 1 and 2, in operation, the tub table 1 is employed in a bathing structure 22 having a liquid 20 of depth d filled therein. The bathing structure 22 is preferably provided with both a base 8 and continuously upwardly projecting sidewalls 23. The pedestal support 2 is structured in its attachment to support tray 12 to define a height h between the base 8 and lower surface 16 of the support tray 12. The height h is preferably provided to accommodate a user in the bathing structure 22 when placing or retrieving an item 18 on support tray 12. The height h is most preferably from about 8 to 16 inches.

Referring again to FIG. 1, the pedestal support 2 may be upwardly tapered in order to provide a lower portion 6 which is wider or thicker relative to upper portion 4. The pedestal support 2 is preferably comprised of a conventional, heat-resistant material capable of utilization in an elevated temperature bathing environment. The pedestal support 2 is most preferably comprised of a material selected from the group consisting of resinous plastic, rubber, and fiber reinforced composites. The pedestal support 2 may also be composed of a laminated combination, such as metal foil laminated to a resinous plastic. The pedestal support 2 may also define a solid cross-section or it may be hollow in that the pedestal support 2 defines at least one wall which encloses a void within the pedestal support 2. The pedestal support 2 may also comprise inner and outer walls which define a void therebetween. The pedestal support 2 is preferably comprised of a material which provides a resilient flexibility to the pedestal support 2 structure.

Referring again to FIG. 1, the support tray 12 of the present invention will preferably provide a suitable location for placement and retrieval for items such as item 18. The support tray 12 may be provided conventionally formed in any suitable shape such as, for example, a circular, rectangular, triangular, or other polygonal shape. For application by a child user, a support tray 12 formed in the shape of a circle is preferred. The support tray 12 is preferably composed of a conventional, heat-resistant material capable of utilization in an elevated temperature bathing environment. The support tray 12 is most preferably composed of a material selected from solid resinous plastic, rubber, fiber reinforced composites, and similar materials which will provide for a substantially rigid support tray 12 structure. It will be understood that the material used for the composition of support tray 12 will depend on considerations such as the end use application for the support tray 12 and the specific environment where it will be employed. The support tray 12 also has a thickness t of about ½ to 4 inches.

Figure 3:
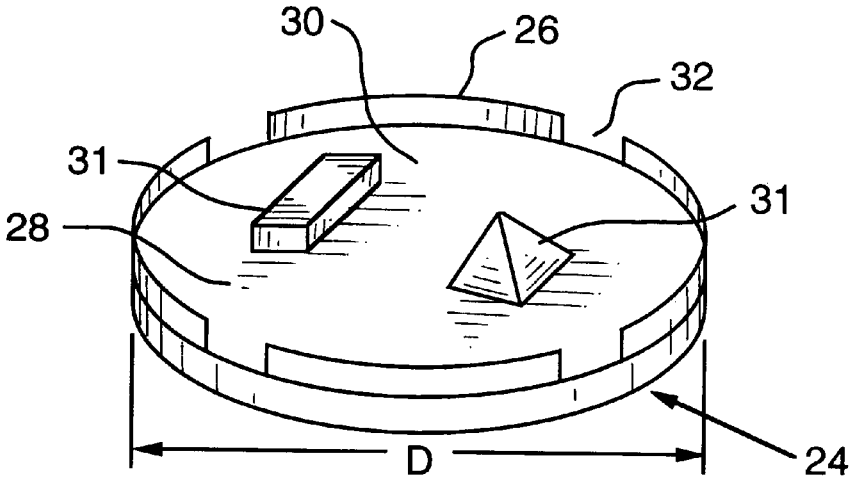
FIG. 3 is a perspective view of the support tray of the present invention.

Referring now to FIG. 3, the support tray 24 of the present invention may be provided with an outer rim 26 which projects generally upwardly from an upper surface 28 of support tray 24. In this embodiment of the present invention, outer rim 26 defines therein a generally upwardly open recess 30. The recess 30 is conventionally formed so as to provide a site for placement and retrieval of items 31, which may be toys, employed by a user in a bathing environment. The support tray 24 may also include an outer rim 26 which is contiguous with the upper surface 28 of support tray 24 extending around at least a major portion of the periphery of support tray 24. Drainage openings 32 may also be formed in the outer rim 26 to permit water or other liquids to pass through these drainage openings 32 and exit from the upper surface 28 of support tray 24 to return to the bathing environment. The shape of the support tray 24 may be provided in the form of a circle having a diameter D of about 12 to 18 inches.

Figure 4:
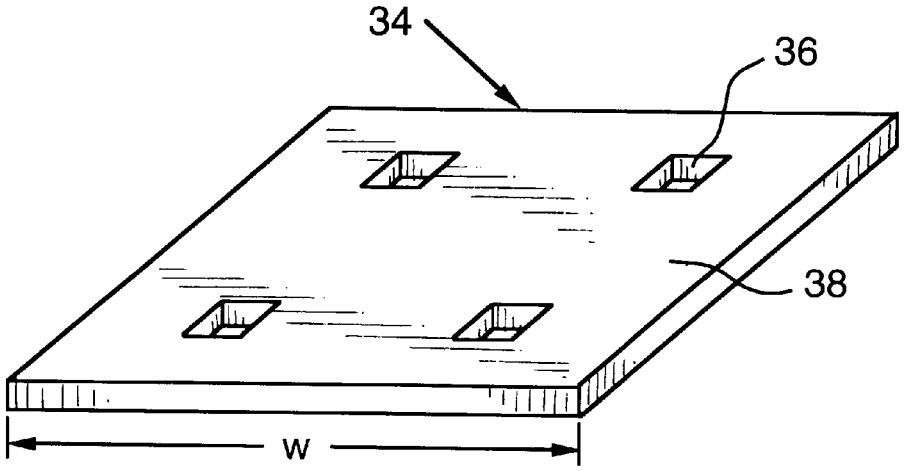
FIG. 4 is a perspective view of the support tray of the present invention.

Referring now to FIG. 4, support tray 34 of the present invention may be embodied with at least one passageway 36 extending therethrough to permit a liquid, such as water employed in a bathing environment, to pass through the support tray 34 and alleviate potential accumulation of liquid on the upper surface 38 of support tray 34 while in use for holding and supporting items. The support tray 34 will preferably be provided with a width w which is less than the width of the opening of a conventional bathing structure. The width w is preferably in the range of about 12 to 18 inches.

Figure 5:
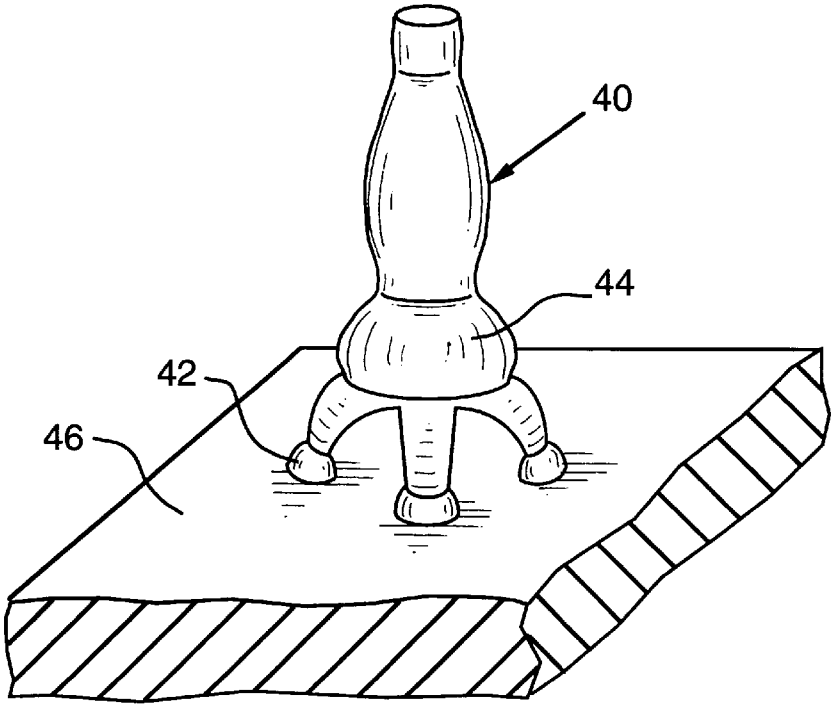
FIG. 5 is a perspective view of a portion of the pedestal support of the present invention.

Referring now to FIG. 5, an additional embodiment of the present invention is shown. The pedestal support 40 may have a plurality of suction cups 42 attached to its lower portion 44. The suction cups 42 provide for releasable securement of the pedestal support 40 to the base 46 of a bathing structure. Preferably, from one to six suction cups 42 may be employed. It will be appreciated that the number of suction cups 42 may be suitably selected to provide sufficient support based on the structure and composition of the pedestal support 40 and considerations such as the dimensions of the support tray (not shown) mounted thereon.

Figure 6:
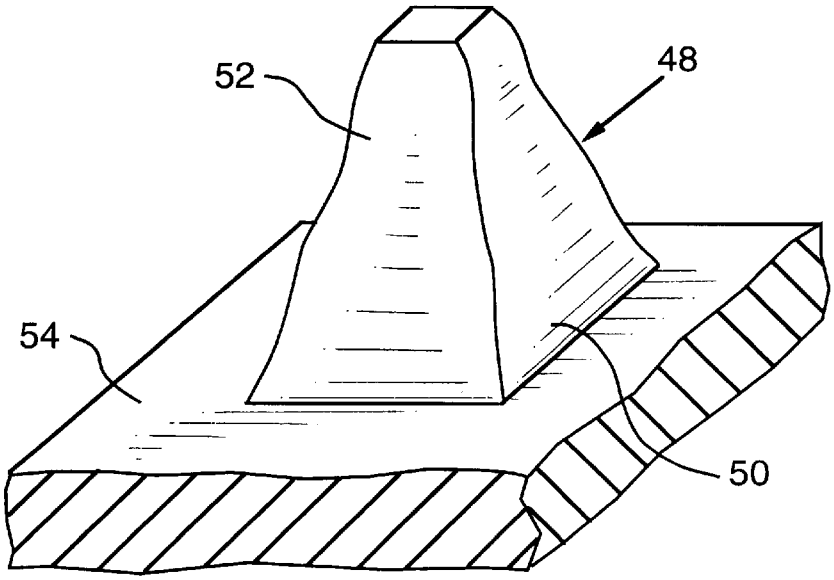
FIG. 6 is a perspective view of a portion of the pedestal support of the present invention.

As shown in FIG. 6, the pedestal support 48 of the present invention may be provided with a lower portion 50 which is substantially wider relative to upper portion 52 of pedestal support 48. Lower portion 50 may be attached to base 54 by any suitable, conventional fastening apparatus or method which provides for a releasable securement between lower portion 50 and base 54.

Referring again to FIGS. 1 and 2, in a method embodiment of the present invention, a method for a user to support items 18 with a bathing structure 22 having a base 8 and continuously upwardly projecting sidewalls 23 in a bathing environment is provided. The method begins by providing a pedestal support 2 having an upper portion 4 and a lower portion 6. A support tray 12 is also provided mounted to the upper portion 4 of the pedestal support 2. Next, the method includes securing the lower portion 6 of pedestal support 2 to the base 8 of a bathing structure 22. Finally, the method includes using the support tray 12 to support item 18 or items in a bathing environment. In this method of the present invention, supported items may be a toy or toys such as item 18.

The tub table of the present invention provides significant advantages in its structure and method of use. The pedestal support structure provides for removable or permanent attachment of a table to a bathing structure and does not require support from the sidewalls of the bathing structure. The tub table also offers a location for placement and retrieval of items, such as toys, which are supported by the tub table away from the periphery of the bathing structure.

The tub table of the present invention also provides an attractive device to focus the attention of a bathing child on the tub table. Focusing attention on the tub table may provide for a bather who is more cooperative during the bathing process.

Whereas prime emphasis has been placed on supporting the toy items of a child bather, it will be understood that the apparatus of the present invention could be used for books, magazines, personal hygiene apparatus, and the like.

It will be appreciated that the primary use for the tub table apparatus and method of the present invention is to support items used by a bather. The present invention is not intended to support a bather in entrance to, egress from, or transit within a bathing structure.

While certain words of relative orientation, such as "upper" and "lower", have been employed to illustrate the present invention, it will be understood that these words are intended for clarification purposes only and are not intended to limit the scope of the present invention.

Whereas particular embodiments of this invention have been described above for purposes of illustration, it will be evident to those skilled in the art that numerous variations of the details of the present invention may be made without departing from the invention as defined in the appended claims.

What is claimed is:

1. A tub table structured for use with a bathtub having a base and upwardly projecting sidewalls comprising:

a pedestal support having upper and lower portions, said lower portion being securable to said base of said bathtub;

a support tray having a lower portion mounted on said upper portion of said pedestal support;

said lower portion of said pedestal support being structured to be removably secured to said base of said bathtub by at least one to six suction cups attached to said lower portion;

said pedestal support comprising a unitary upwardly tapered pedestal support; and, said lower portion of said pedestal support being wider than said upper portion of said pedestal support;

said tray further has an outer rim contiguous with said tray and extending around at least a major portion of the periphery of said tray;

said outer rim has a generally upwardly projecting outer rim; and said outer rim being discontinuous at a plurality of locations therearound, forming completely upwardly open drain openings.

2. The tub table of claim 1, further comprising a plurality of feet connected to said lower portion of said pedestal support.

3. The tub table of claim 1, wherein said tray comprises at least one passageway extending therethrough to permit liquid to pass through said tray.

4. The tub table of claim 1, wherein said tray is connected to said upper portion of said pedestal support by a mounting device attached to said tray so as to provide removable engagement between said tray and said pedestal support.

5. The tub table of claim 1, wherein said tray is substantially permanently secured to said upper portion of said pedestal support.

6. The tub table of claim 1, wherein said tray is composed of a material selected from the group consisting of resinous plastic, rubber, and fiber reinforced composite.

7. The tub table of claim 1, wherein said pedestal support is composed of a material selected from the group consisting of resinous plastic, rubber, and fiber reinforced composite.

8. The tub table of claim 1, wherein a distance from said base to said lower surface of said tray is about 8 to 16 inches.

9. In combination, a bathtub having a base and upwardly projecting sidewalls and a tub table comprising:

a pedestal support having upper and lower portions, said lower portion being secured to said base of said bathing structure;

a support tray having a lower surface mounted on said upper portion of said pedestal support;

said lower portion of said pedestal support being removably secured to said base of said bathtub by at least one to six suction cups attached to said lower portion;

said pedestal support comprising a unitary upwardly tapered pedestal support; and, said lower portion of said pedestal support being wider relative to said upper portion of said pedestal support;

said tray further has an outer rim contiguous with said tray and extending around at least a major portion of the periphery of said tray;

said outer rim has a generally upwardly projecting outer rim; and said outer rim being discontinuous at a plurality of locations therearound, forming completely upwardly open drain openings.

10. The tub table of claim 9, further comprising a plurality of feet connected to said lower portion of said pedestal support.

11. The tub table of claim 9, wherein said tray comprises at least one passageway extending therethrough to permit liquid to pass through said tray.

12. The tub table of claim 9, wherein said tray is connected to said upper portion of said pedestal support by a mounting device attached to said tray so as to provide removable engagement between said tray and said pedestal support.

13. The tub table of claim 9, wherein said tray is substantially permanently secured to said upper portion of said pedestal support.

14. The tub table of claim 9, wherein said table is composed of a material selected from the group consisting of resinous plastic, rubber, and fiber reinforced composite.

15. The tub table of claim 9, wherein said pedestal support is composed of a material selected from the group consisting of resinous plastic, rubber, and fiber reinforced composite.

16. The tub table of claim 9, wherein a distance from said base to said lower surface of said tray is about 8 to 16 inches.

17. A method of supporting items in a bathtub having a base and continuously upwardly projecting sidewalls comprising:

(a) providing a pedestal support having upper and lower portions, said pedestal support comprising a unitary upwardly tapered pedestal support, said lower portion of said pedestal support being wider relative to said upper portion of said pedestal support, said lower portion having at least one to six suction cups attached thereto and a support tray having an outer rim contiguous with said tray and extending around at least a major portion of the periphery of said tray, said outer rim having a generally upwadly projecting outer rim, and, said outer rim being discontinuous at a plurality of locations therearound, forming completely upwardly open drain openings;

(b) mounting said support tray on said upper portion of said pedestal support;

(c) securing said lower portion of said pedestal support to said base of said bathtub with said suction cups; and, (d) using said tray to support items in said bathtub.

18. The method of claim 17, including using said tray to support toys.

* * * * *

UNITED STATES PATENT AND TRADEMARK OFFICE

CERTIFICATE OF CORRECTION

PATENT NO. : 6,298,501 B1
DATED : October 9, 2001
INVENTOR(S) : Linda M. Beichner It is certified that error appears in the above-identified patent and that said Letters Patent is hereby corrected as shown below:

Column 6,
Line 43, after "table" insert -- and bathtub combination --.
Line 46, after "table" insert -- and bathtub combination --.
Line 49, after "table" insert -- and bathtub combination --.
Line 54, after "table" insert -- and bathtub combination --.
Line 57, after "table" insert -- and bathtub combination --.
Line 60, after "table" insert -- and bathtub combination --.
Line 63, after "table" insert -- and bathtub combination --.

Signed and Sealed this

First Day of October, 2002

*Attest:*

*Attesting Officer*

JAMES E. ROGAN
*Director of the United States Patent and Trademark Office*